US005380231A

United States Patent [19]

Brovelli

[11] Patent Number: 5,380,231

[45] Date of Patent: Jan. 10, 1995

[54] TOY THAT DISASSEMBLES UPON AN IMPACT

[75] Inventor: Virginio Brovelli, Taino, Italy

[73] Assignee: Lanard Toys Limited, Kowloon, Hong Kong

[21] Appl. No.: 152,578

[22] Filed: Nov. 15, 1993

[51] Int. Cl.[6] ..... A63H 17/02; A63H 17/00; A63H 17/40; A63H 17/26

[52] U.S. Cl. ..... 446/6; 446/435; 446/441; 446/471

[58] Field of Search ..... 446/4, 6, 5, 308, 309, 446/310, 311, 312, 431, 435, 441, 442, 469, 470, 471

[56] References Cited

U.S. PATENT DOCUMENTS

| | | | |
|---|---|---|---|
| 1,277,702 | 9/1918 | Des Combes | 446/4 X |
| 1,546,431 | 7/1925 | Brandt | 446/310 X |
| 2,757,482 | 8/1956 | Brown et al. | 446/6 |
| 2,803,920 | 8/1957 | Salosky | 446/6 |
| 3,148,478 | 9/1964 | Miller | 446/435 |
| 3,859,752 | 1/1975 | Merrison et al. | 446/6 |
| 3,959,920 | 6/1976 | Ieda | 446/6 |
| 4,173,095 | 11/1979 | Pauly et al. | 446/470 |

FOREIGN PATENT DOCUMENTS

| | | | |
|---|---|---|---|
| 0316236 | 5/1989 | European Pat. Off. | 446/471 |
| 339120 | 12/1930 | United Kingdom | 446/6 |
| 1347963 | 10/1987 | U.S.S.R. | 446/471 |

*Primary Examiner*—Robert A. Hafer
*Assistant Examiner*—D. Neal Muir
*Attorney, Agent, or Firm*—Brumbaugh, Graves, Donohue & Raymond

[57] ABSTRACT

A toy that disassembles upon an impact comprises a body, a plurality of detachable elements, a mount for supporting each detachable element in a predetermined position on the body, and a resilient ejector mechanism engaged between the body and each detachable element and biasing the element in a direction to detach it from the mount. A movable latch member on the body engages each detachable element and retains it on the mount against the bias of the ejector mechanism. A latch release member movably mounted on the body in a position to be moved by engagement with an object releases the latch members from engagement with the detachable elements upon such movement, whereupon the detachable elements are ejected from the mount by the ejector mechanism. The latch release member can be locked against movement, thereby disabling it and permitting the toy to be played with without disassembling.

19 Claims, 4 Drawing Sheets

TOY THAT DISASSEMBLES UPON AN IMPACT

BACKGROUND OF THE INVENTION

Toys that come apart and that the user has to put back together are enjoyable and popular. Examples of simple forms of such toys are ordinary blocks, "Tinkertoys," "Lego" blocks and the like. Vehicles that include detachable components, often in the form of cargo that is loaded and unloaded, are also widely available.

SUMMARY OF THE INVENTION

An object of the present invention is to provide a unique toy that automatically disassembles upon impact. Another object is to provide such a toy in the form of a simulated wheeled vehicle that dissembles upon a frontal impact. The present invention is applicable to other simulated vehicles, such as boats and aircraft. Still another object is to provide for degrees of disassembly, depending upon the magnitude of the impact. It is also desired to provide for disabling the mechanism that causes the toy to disassemble, thereby permitting it to be played with without having it come apart.

The foregoing objects are attained, in accordance with the present invention, by a toy comprising a body, at least one detachable element, a mounting arrangement for supporting the detachable element in a predetermined position on the body, and a resilient ejector engaged between the body and the detachable element and biasing the element in a direction to detach it from the mounting arrangement. A latch on the body that includes a movable latch member engaging the detachable element retains the element on the mounting arrangement against the bias of the ejector. A release device including a release member movably mounted on the body in a position to be moved by engagement with an object releases the latch means from engagement with the detachable element upon such movement, whereupon the detachable element is ejected from the mounting arrangement by the ejector.

In preferred embodiments of the invention, the ejector includes a guide tube attached to the body, a plunger movably mounted in the guide tube, and a compression ejector spring engaging the plunger. The latch member is a lever that is pivotally mounted on the body and is resiliently biased to engage the detachable element by a latch spring. The detachable element includes a shoulder engageable by a latch hook portion of the lever and a cam surface engageable with the lever to deflect the lever against the bias of the latch spring so as to enable the detachable element to snap into its latched position with the hook portion engaging the shoulder.

The release mechanism, preferably, includes a holding spring resiliently biasing the release member in a direction to oppose its movement to release the latch means. To disable the release member and allow the toy to be played with without coming apart, a lock is provided for selectively locking the latch release member against movement in a direction to release the latch.

The toy can be configured as a simulated wheeled vehicle. Suitable components of the vehicle that can be made detachable include wheel assemblies. For example, the toy may have a pair of front wheels and a pair of rear wheels, the wheels of each pair being located on either side of the body and being coaxial with each other. Each wheel is rotatably mounted on an axle, each axle is mounted on an axle holder, and each axle holder is telescopically received by a guide tube of an ejector.

The guide tube of the ejector for each wheel of each pair may be unitary with the guide tube for the other wheel of the pair, and the ejector spring for each wheel of each pair is unitary with the ejector spring for the other wheel of the pair.

The simulated vehicle may be of a type that has no top, such as a jeep-like vehicle or a convertible with the top down, and a suitable detachable element in such a vehicle includes the seat. Another suitable detachable element for a simulated motor vehicle is a hood. The release member of the latch release for a simulated vehicle may include a simulated front bumper portion.

For added play value, the release member can be arranged to release the respective latch members from engagement with the corresponding detachable member by moving a predetermined lost-motion distance, the lost-motion distances for some of the detachable members being different from others such that the release is operable to release less than all of the latch members from engagement with the corresponding detachable elements upon application of forces to the release member less than a predetermined force that releases all of the latch members from engagement with the corresponding detachable members. Such forces are less than the cumulative opposing force of the release spring and the latch springs and result in a movement of the release member that is less than the lost-motion movement for releasing some of the latch members from the corresponding detachable members. The user can push the vehicle toward an obstruction with lesser or greater force and, depending upon the impact, different ones of the detachable elements are ejected. The user can, therefore, attempt to attain a particular crash result in terms of the degree of "destruction" of the vehicle. To this end, a preferred embodiment of the release member and each latch member have coacting lugs and slots providing lost-motion couplings between the release member and each latch member upon movement of the release member, the slots having different initial clearance distances from the lugs, i.e., different lost-motion distances.

For a better understanding of the invention, reference may be made to the following description of an exemplary embodiment, taken in conjunction with the accompanying drawings.

DESCRIPTION OF THE EMBODIMENT

Figure 1:
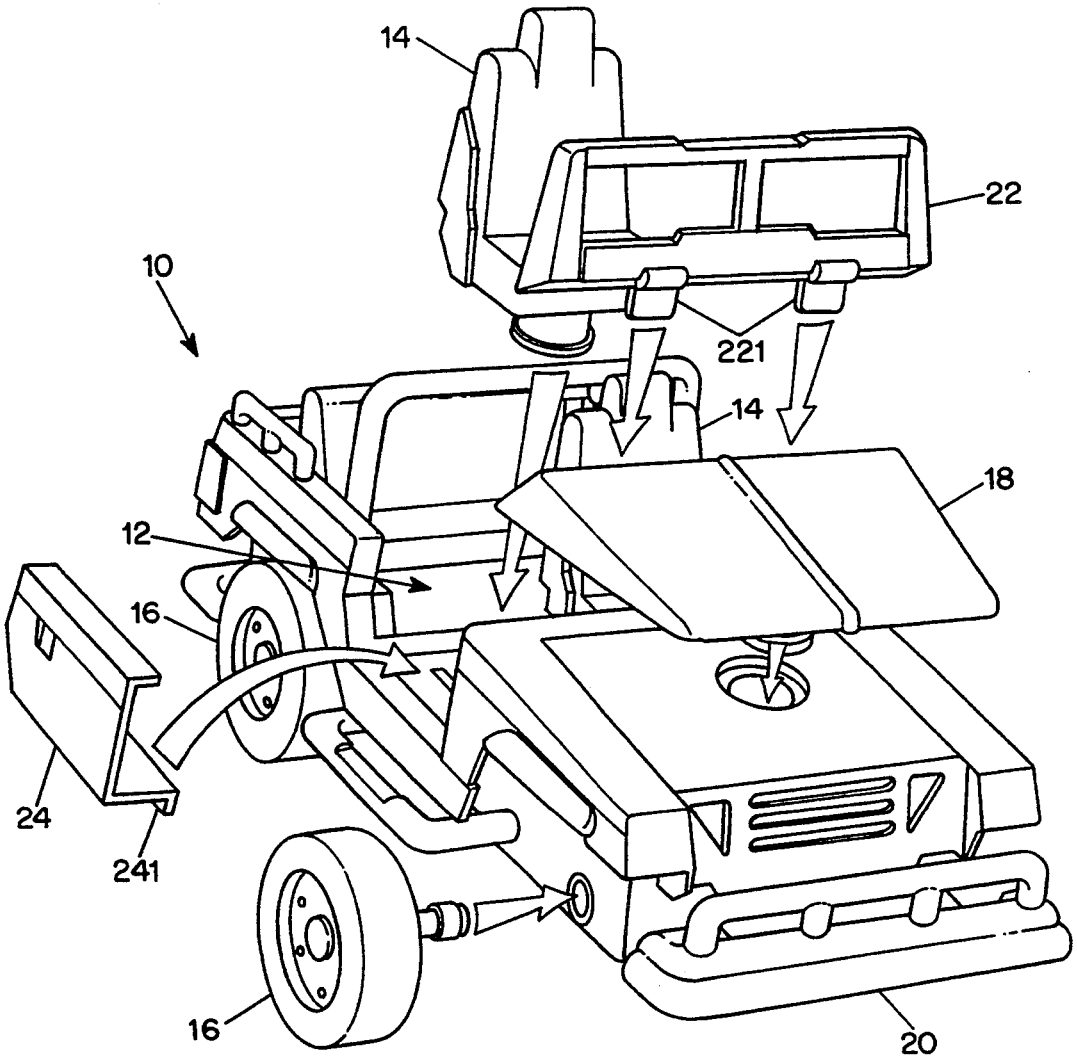
FIG. 1 is pictorial view of the embodiment, showing some of the detachable components dislodged from their installed positions.
Figure 3:
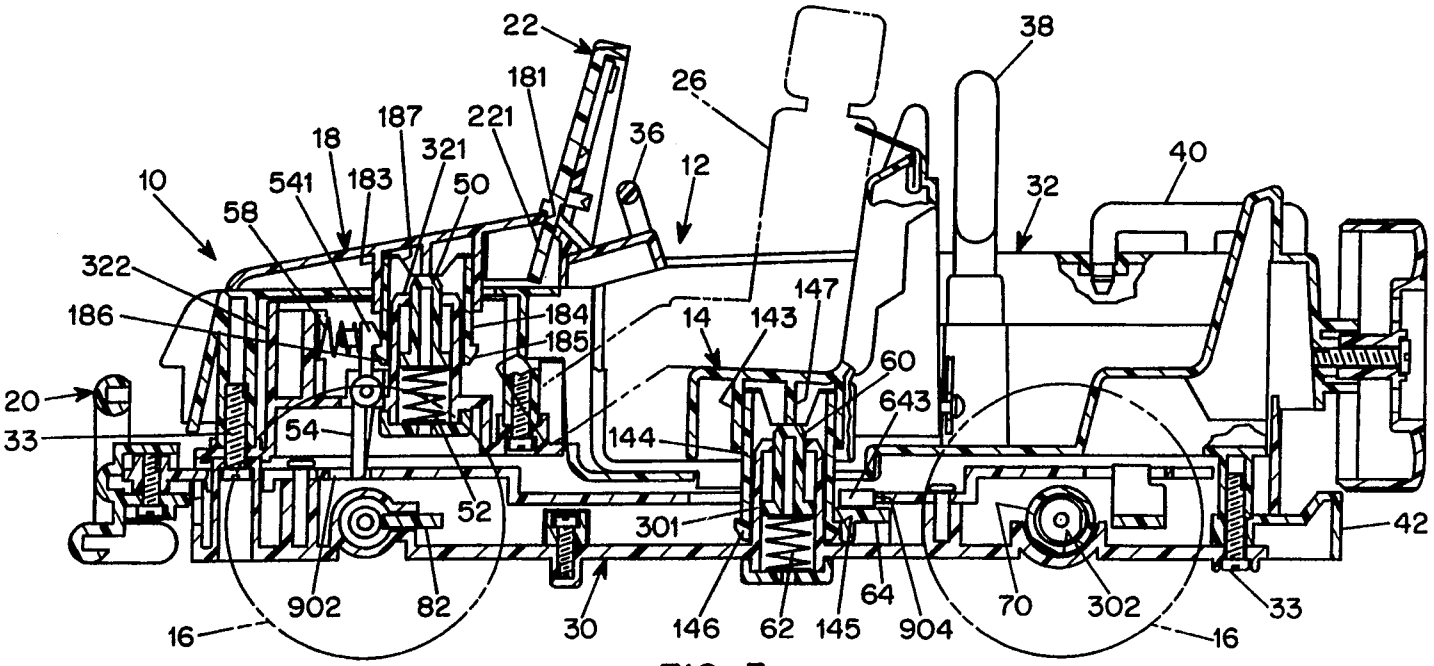
FIG. 3 is a side cross-sectional view of the embodiment in which some portions are broken away and the release member is the inactive position.
Figure 5:
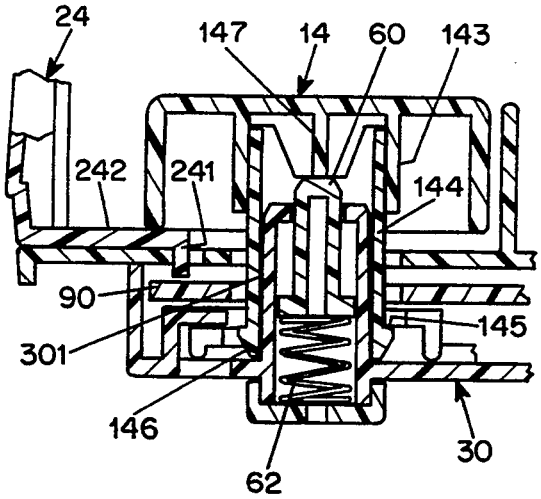
FIG. 5 is a partial end cross-sectional view taken along the lines 5—5 of FIG. 2.

As best seen in FIG. 1, the embodiment is a vehicle 10 that simulates a jeep in appearance. The passenger compartment 12 contains two seats 14 and is open (topless). The detachable elements are the seats 14, all four wheels 16, and the hood 18, all of which are ejected when the front bumper 20 strikes something (or is struck or pushed on) with sufficient force to activate fully the ejection release mechanism, as described below. In addition, the windshield 22 is mounted on the hood by tabs 221 that fit loosely into slots 181 in the hood (see FIG. 3) so that when the hood is ejected, the windshield separates from the hood. Also, the doors 24 are mounted on the body by tabs 241 that are located on the laterally inward edges of bottom flanges 242 that are located under the seats when the seats are installed (see FIG. 5). The doors are held in position by the seats; when the seats are dislodged, the doors fall off. Toy FIGS. 26 (shown diagrammatically in FIG. 3) are strapped into the seats by seat belts. When the seats are ejected from the body, the FIGS. 26 go with them. The user can detach the seat belts that hold the figures, in which event the figures will be thrown from the seats when the seats are ejected.

Figure 6:
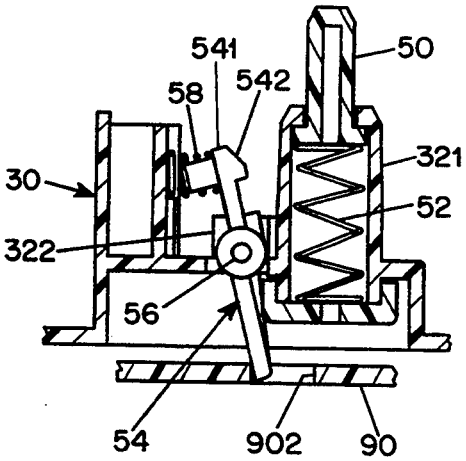
FIG. 6 is a fragmentary side cross-sectional view of the hood ejector mechanism and its latch, showing them in the release position.
Figure 7:
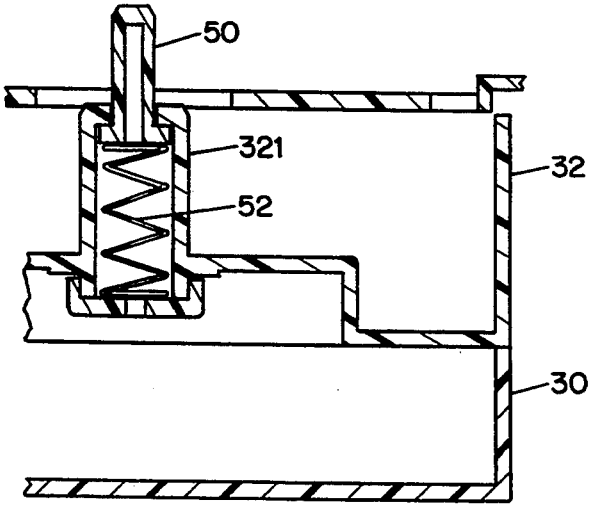
FIG. 7 is a fragmentary end cross-sectional view of the hood ejector mechanism and its latch, showing them in the release position.

The body of the vehicle is composed of a bottom member 30 and a top member 32, which are joined at final assembly of the vehicle by screws (e.g. 33). Various decorative components are attached in a suitable manner to the body: running boards 34; a steering wheel 36; a roll bar 38; grab bars 40; a rear bumper 42. The detachable elements are mounted on one or the other body members by mounts that hold them in predetermined positions when they are installed in a manner that enables them to detach from the body member. An ejector is engaged between each detachable element and the body member on which it is mounted. A latch holds each detachable member in place on the body member against the bias of the ejector. A release member movably mounted on the vehicle body in a position to receive an impact from an external object disengages the latches from the detachable elements, whereupon the detachable elements are ejected from their mounting supports by the respective ejectors, In particular, referring to FIGS. 3, 6, and 7, the mount for the hood 18 is a socket portion 321 formed integrally with a portion 322 of the upper body member 32 located under the hood 18. An annular flange 183 on the underside of the hood receives a cylindrical latch piece 184, which is secured to the flange 183 such as by gluing, fits telescopically with a loose fit over the socket portion 321, and has a latch-engageable shoulder 185 adjacent its lower edge and a cam surface 186 along its lower edge. The socket portion 321 receives an ejector plunger 50, which is biased by a compression coil spring 52 into engagement with the lower edges of ribs 187 within the flange 183 on the hood. A latch lever 54 having a hook portion 541 adjacent its upper end that engages the latch piece shoulder 185 is pivotally mounted on lugs 322 on the body member 32 by a pivot pin 56 and is biased by a spring 58 into the engaged position. The hood is installed on its mount by fitting the latch piece to the flange and pushing down on the hood, whereupon the cam surface 186 on the latch piece 184, working against a cam surface 542 on the on the latch lever 54, pivots the lever against the bias of the spring 58, thereby allowing the latch piece to snap into its latched position. When the hood is pushed down into place, the ejector plunger is also pushed down and compresses the ejector spring 52 to store energy in it.

The mounts for the seats 14 (see FIG. 5) are virtually identical to each other and essentially the same as the mount for the hood. Each includes a socket portion 301 on the lower body member 30 located under the seat. An annular flange 143 on the underside of the seat 14 receives a cylindrical latch piece 144, which is secured to the flange 143 such as by gluing, fits telescopically with a loose fit over the socket portion 301, and has a latch-engageable shoulder 145 adjacent its lower edge and a cam surface 146 along its lower edge. The socket portion 301 receives an ejector plunger 60, which is biased by a compression coil spring 62 into engagement with the lower edges of ribs 147 within the flange 143 on the seat. A latch lever 64, having a semi-circular notch 641 adjacent its end that engages the latch piece shoulder 145 as a hook, is pivotally mounted on the body member 32 by a pivot pin 66 and is biased by a spring 68 into the engaged position. Each seat 14 is installed on its mount by fitting the latch piece 141 to the socket and pushing down on the seat. The cam surface 146 on the latch piece, working against the edge of the lever notch 641, pivots the lever 64 against the bias of the spring 68, thereby allowing the latch piece to snap into its latched position. When the seat is pushed down into place, the ejector plunger 60 is also pushed down and compresses the ejector spring 62 to store energy in it. The latch levers 64 share the same pivot pin 66 and latch spring 68.

The mounts for the wheels are essentially identical and are very similar to the hood mount and seat mount. Each mount includes a cylindrical socket member 70 that nests in a concavity 302 on the lower body member 30 and opens laterally outwardly to receive an axle holder 71 of the wheel assembly 16. A wheel 72 is rotatably mounted on an axle 74 affixed to the axle holder. Between each laterally opposite pair of wheel mount socket members 70 is an ejector mechanism, which includes a guide tube 76, a plunger 78 for each wheel assembly of that pair and an ejector spring 80. A latch lever 82 for each wheel mount of each pair is pivotally mounted on a pivot pin 84 and is biased by a spring 85 about the pivot pin in a direction to engage a locking hook portion 821 in a groove 711 in the axle holder 71. A cam surface 712 on the tip of each axle holder interacts with a cam surface 822 on the corresponding lever 82 to enable the axle holder to be pushed into the socket member 70 and deflect the lever. When the axle holder 71 is seated in the socket member 70, the locking hook portion 821 of the lever 82 snaps into locking engagement with the groove 711 in the axle holder 70. Installation of each axle compresses the corresponding ejector spring 85, thereby storing energy, which is returned when the wheel assemblies are ejected.

Figure 2:
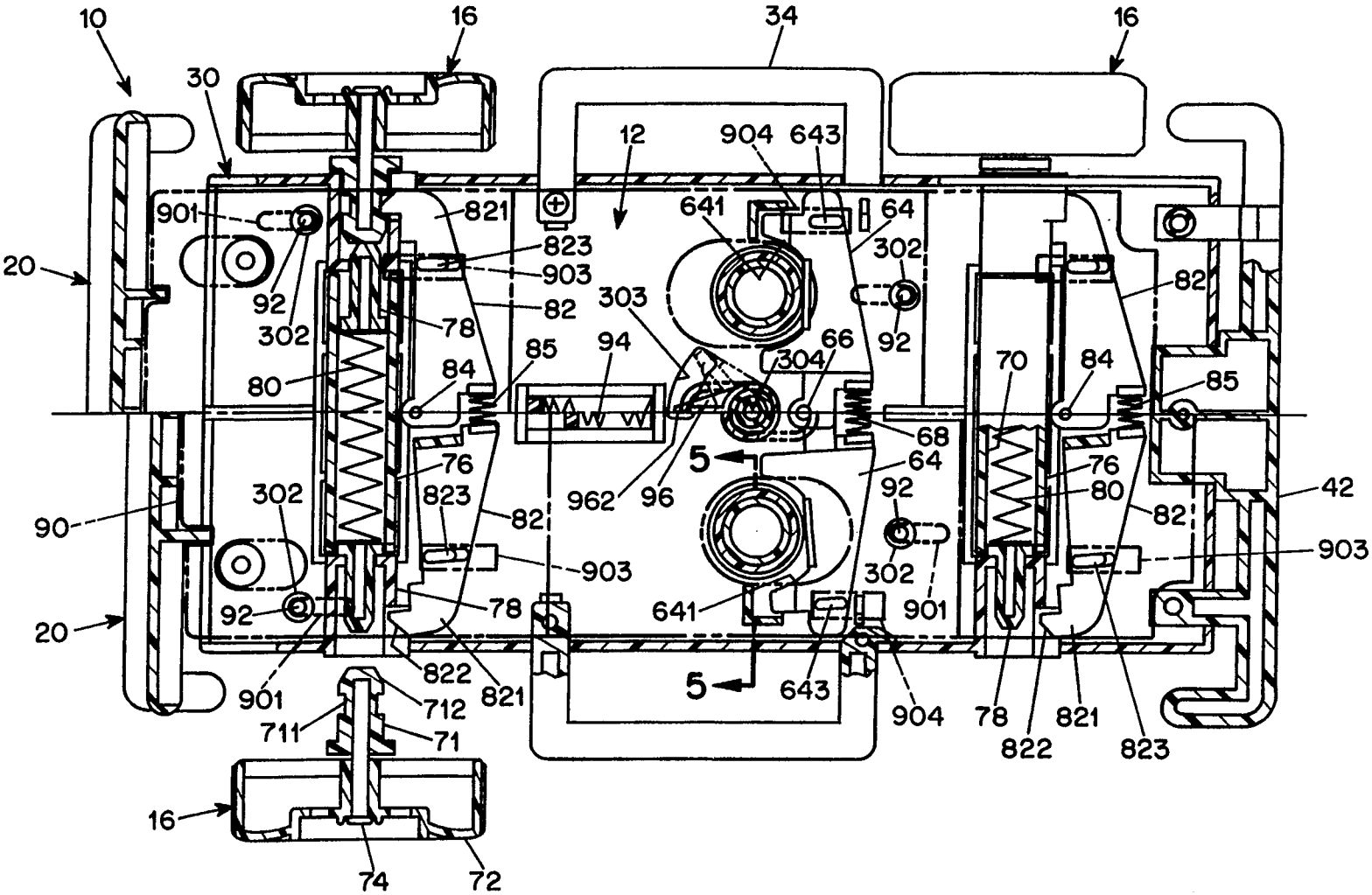
FIG. 2 is a top cross-sectional view of the embodiment, one lateral half showing the position of the components when the release member is inactive and the other lateral half showing the position when the release member is activated to enable ejection of the detachable elements and also showing some of the detachable elements removed.

As described above, the spring-biased latch levers retain the detachable elements on the body against the biases of the ejector springs. Upon an impact to the front bumper 20, a release member 90 (shown in phantom lines in FIG. 2), which is attached to the bumper 20, is mounted on bosses 302 on the lower body member and is retained by pins 92 received in elongated slots 901 so as to be slidable, pushes the latch levers against the biases of the latch springs and releases the detachable elements. The detachable elements thereupon fly off of the body under the forces of the ejector springs.

Figure 4:
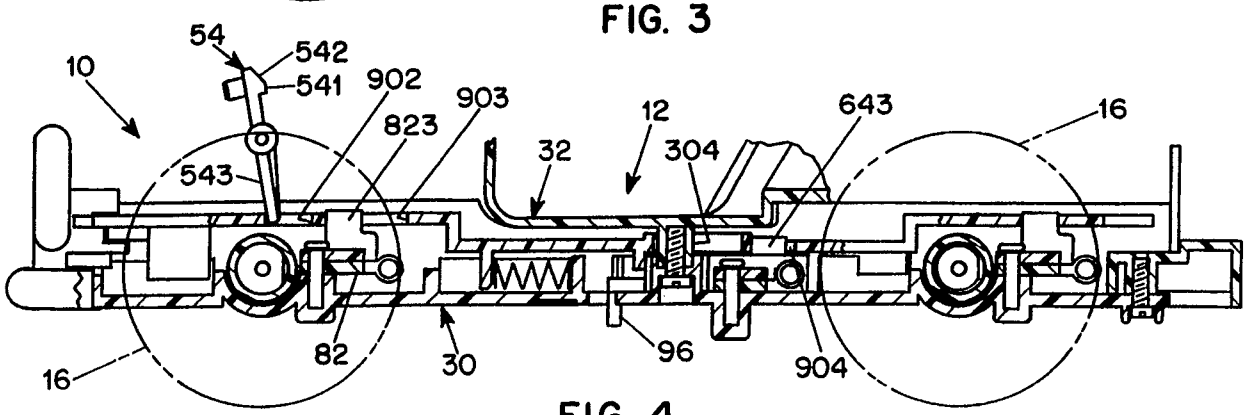
FIG. 4 is a side cross-sectional view of the embodiment in which some portions are broken away and the release member is the active position.

In particular, the release member 90, which is a plate-like part, has: a slot 902 (FIGS. 3 and 4) that receives the lower arm 543 of the hood latch lever 54; a slot 903 that receives a projecting lug 823 on a corresponding wheel latch lever 82 (there are four slots 902, one for each wheel latch lever 82); and a slot 904 that receives a projecting lug 643 of a corresponding seat latch lever 64 (there are two slots 904, one for each of the two seats). Each slot is in a lost-motion relationship to the element it receives; that is, the release member has to move a certain distance before it engages the corresponding latch lever and moves it far enough to disengage the detachable element it retains. For increased play value, the lost-motion distances through which the release member must displace before releasing the hood, seats and wheels are different. Inasmuch as the release member 90 is biased forwardly by a spring 94 and also has to overcome the forces of the latch springs in order to pivot the latch levers to release them, the different lost-motions to release the respective latch levers results in incremental force levels opposing the movement of the release member upon an impact to it. Accordingly, a relatively small impact to the front bumper will not cause the release member to move against the aggregate opposing force of its biasing spring 94 and that (or those) of the detachable member having the smallest lost-motion distance, and the toy will not disassemble upon such an impact. Similarly, a moderate impact will be sufficient to overcome the aggregate forces of the spring 94 and some, but not all, of the latch springs. Such an impact will cause some, but not all, of the detachable elements to be ejected. A large impact force will cause all of the detachable elements to be ejected.

Figure 8:
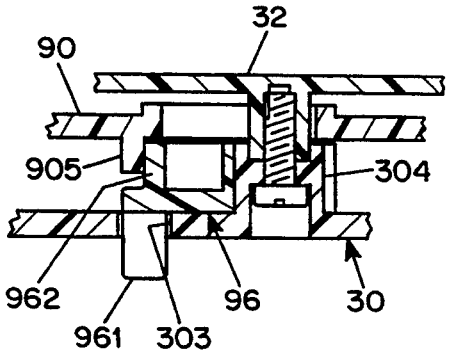
FIG. 8 is a fragmentary side cross-sectional view of the lock device for disabling the ejector mechanism.

The disassembling function of the toy can be disabled, allowing the toy to be played with, including running it into things or otherwise imposing impacts to the front bumper, without it disassembling. A locking lever 96 having a finger-engageable arm portion 961 protruding through a slot 303 in the bottom body member 30 is pivotally received on a screw boss 304 (located below the seat). In its counterclockwise-most position in the slot, with respect to FIG. 2 (solid line showing in FIG. 2 and see FIG. 8), a blocking arm 962 on the lever engages a dependant stop lug 905 on the release member 90, thereby preventing the release member from displacing from its normal, forward position. When rotated clockwise, phantom lines in FIG. 2, the locking lever 96 allows the release member to move rearwardly and disengage the latch levers from the detachable elements of the toy, as described above.

I claim:

1. A toy configured as a simulated wheeled vehicle that disassembles upon an impact comprising a body, detachable elements including four wheel assemblies, mounting means for supporting each detachable element in a predetermined position on the body including a guide tube and a portion of the detachable element that is telescopically received by the guide tube; resilient ejector means engaged between the body and each detachable element and biasing the element in a direction to detach it from the mounting means, each ejector means including the guide tube, a plunger movably mounted in the guide tube, and a compression ejector spring engaging the plunger; latch means on the body including a movable latch member that is pivotally mounted on the body and is resiliently biased to engage the detachable element by a latch spring for retaining the element on the support means against the bias of the ejector means; and latch release means including a release member movably mounted on the body in a position to be moved by engagement with an object for releasing the latch means from engagement with the detachable element upon such movement, whereupon the detachable element is ejected from the support means by the ejector means.

2. A toy according to claim 1 wherein the detachable element includes a shoulder engageable by a latch hook portion of the lever and a cam surface engageable with the lever to deflect the lever against the bias of the latch spring so as to enable the detachable element to snap into its latched position with the lug portion engaging the shoulder.

3. A toy according to claim 1 wherein the latch release means further includes a holding spring resiliently biasing the release member in a direction opposite to that in which the release member is moved to release the latch means.

4. A toy according to claim 1 and further comprising lock means for selectively locking the latch release member against movement in a direction to release the latch means.

5. A toy according to claim 1, wherein the guide tube is positioned laterally of the body, the mounting means includes a socket portion located laterally of the body and opening at the side of the body, and the wheel assembly includes a wheel support telescopically received within the socket.

6. A toy according to claim 5, wherein the wheel assembly further includes an axle affixed to the wheel support and a wheel rotatably mounted on the axle.

7. A toy according to claim 1, wherein the wheel assemblies are positioned to form a pair of front wheels and a pair of rear wheels, the wheels of each pair being located on either side of the body and being coaxial with each other, wherein each wheel is rotatably mounted on an axle, each axle is mounted on an axle holder, and each axle holder is telescopically received by a guide tube of the ejector means.

8. A toy according to claim 7, wherein the guide tube of the ejector means for each wheel of each pair is unitary with the guide tube for the other wheel of the pair, and the ejector spring for each wheel of each pair is unitary with the ejector spring for the other wheel of the pair.

9. A toy according to claim 1, the toy being a simulated topless vehicle, and wherein the detachable elements include a seat.

10. A toy according to claim 1, wherein the detachable elements include a hood.

11. A toy according to claim 1, wherein the release member of the latch release means includes a simulated front bumper portion.

12. A toy according to claim 1, wherein the release member releases the respective latch members from engagement with the corresponding detachable element by moving a predetermined lost-motion distance, the lost-motion distances for some of the detachable elements being different from others such that the release means is operable to release less than all of the latch members from engagement with the corresponding detachable elements upon application of forces to the release member less than a predetermined force that releases all of the latch members from engagement with the corresponding detachable elements, such forces being less than the cumulative opposing force of the release spring and the latch springs and resulting in a movement of the release member that is less than the lost-motion movement for releasing some of the latch members from the corresponding detachable elements.

13. A toy according to claim 1, wherein the release member and each latch member have coacting lugs and slots providing lost-motion couplings between the release member and each latch member upon movement of the release member.

14. A toy according to claim 1, wherein the slots have different initial clearance lengths from the slots to provide different lost-motion distances.

15. A wheeled toy vehicle that disassembles upon an impact comprising a body, a multiplicity of detachable elements including a pair of front wheels and a pair of rear wheels, two seats, and a hood, and wherein for each of the detachable elements there are a mounting means for supporting the detachable element in a predetermined position on the body, resilient ejector means engaged between the body and the detachable element and biasing the element in a direction to detach it from the mounting means, and a latch means on the body including a movable latch member engaging the detachable element for retaining the element on the support means against the bias of the ejector means, and latch release means including a release member movably mounted on the body in a position to be moved by engagement with an object for releasing the latch means from engagement with the detachable element upon such movement, whereupon the detachable element is ejected from the support means by the ejector means, and the latch release means is operable to release all of the latch means to enable ejection of all of the detachable elements.

16. A toy according to claim 15, wherein the release member of the latch release means includes a simulated front bumper portion.

17. A toy according to claim 16, wherein the release member releases the respective latch members from engagement with the corresponding detachable member by moving a predetermined lost-motion distance, the lost-motion distances for some of the detachable members being different from others such that the release means is operable to release less than all of the latch members from engagement with the corresponding detachable elements upon application of forces to the release member less than a predetermined force that releases all of the latch members from engagement with the corresponding detachable members, such forces being less than the cumulative opposing force of the release spring and the latch springs and resulting in a movement of the release member that is less than the lost-motion movement for releasing some of the latch members from the corresponding detachable members.

18. A toy according to claim 17, wherein the release member and each latch member have coacting lugs and slots providing lost-motion couplings between the release member and each latch member upon movement of the release member.

19. A toy according to claim 18, wherein the slots have different initial clearance lengths from the slots to provide different lost-motion distances.

* * * * *